US009557124B2

(12) United States Patent
Becker

(10) Patent No.: US 9,557,124 B2
(45) Date of Patent: Jan. 31, 2017

(54) DEVICE FOR COCKING A WEAPON, WEAPON STATION AND METHOD FOR OPERATING A WEAPON

(71) Applicant: KRAUSS-MAFFEI WEGMANN GMBH & CO. KG, Munich (DE)

(72) Inventor: Wolfgang Becker, Kassel (DE)

(73) Assignee: KRAUSS-MAFFEI WEGMANN GMBH & CO. KG, Munich (DE)

( * ) Notice: Subject to any disclaimer, the term of this patent is extended or adjusted under 35 U.S.C. 154(b) by 0 days.

(21) Appl. No.: 14/419,247

(22) PCT Filed: Aug. 5, 2013

(86) PCT No.: PCT/DE2013/100282
§ 371 (c)(1),
(2) Date: Feb. 3, 2015

(87) PCT Pub. No.: WO2014/023298
PCT Pub. Date: Feb. 13, 2014

(65) Prior Publication Data

US 2015/0184958 A1 Jul. 2, 2015

(30) Foreign Application Priority Data

Aug. 6, 2012 (DE) ..... 10 2012 107 194

(51) Int. Cl.

| | |
|---|---|
| ***F41A 7/06*** | (2006.01) |
| ***F41A 3/72*** | (2006.01) |
| ***F41A 7/02*** | (2006.01) |
| ***F41A 19/08*** | (2006.01) |

(52) U.S. Cl.
CPC .. *F41A 3/72* (2013.01); *F41A 7/02* (2013.01); *F41A 19/08* (2013.01)

(58) Field of Classification Search
CPC ..... F41A 3/72; F41A 7/06; F41A 19/08
USPC ..... 89/136
See application file for complete search history.

(56) References Cited

U.S. PATENT DOCUMENTS

| | | | | |
|---|---|---|---|---|
| 3,352,206 | A | 11/1967 | Draper, III | |
| 3,427,925 | A | 2/1969 | Horn | |
| 4,974,499 | A * | 12/1990 | Sanderson | F41A 23/00 89/1.4 |
| 7,089,844 | B2 | 8/2006 | Becker | |
| 8,474,360 | B1 * | 7/2013 | Mensch | F41A 7/06 89/1.4 |

(Continued)

FOREIGN PATENT DOCUMENTS

| | | |
|---|---|---|
| CH | 6168 | 12/1892 |
| DE | 1499844 | 6/1970 |

(Continued)

OTHER PUBLICATIONS

PCT, International Search Report, PCT/DE2013/100282 (Nov. 25, 2013).

*Primary Examiner* — Reginald Tillman, Jr.
(74) *Attorney, Agent, or Firm* — Thompson Hine LLP

(57) ABSTRACT

A device for cocking a weapon (11) having an axially movable actuating element (2) that can be coupled to a cocking element (11.1) on the weapon for the purpose of cocking the weapon (11) may include a control device (3) that couples the actuating element (2) to a safety locking element (11.2) on the weapon, whereby the weapon (11) is simultaneously made safe and is armed by actuation of the actuating element.

19 Claims, 5 Drawing Sheets

(56) References Cited

U.S. PATENT DOCUMENTS

| | | | |
|---|---|---|---|
| 2007/0204745 | A1 | 9/2007 | Son et al. |
| 2010/0282058 | A1 | 11/2010 | Nelson et al. |

FOREIGN PATENT DOCUMENTS

| | | |
|---|---|---|
| DE | 1728385 | 3/1972 |
| DE | 102008025499 | 4/2009 |
| EP | 2048468 | 4/2009 |
| WO | 2004/023057 | 3/2004 |

* cited by examiner

DEVICE FOR COCKING A WEAPON, WEAPON STATION AND METHOD FOR OPERATING A WEAPON

TECHNICAL FIELD

The present disclosure relates to devices for cocking weapons, such as automatic weapons, and more particularly, devices for cocking weapons having an axially movable actuating element which can be coupled to a cocking element on the weapon for the purpose of cocking the weapon.

BACKGROUND

From the field of automatic weapons in particular, various types of weapons are known which must in each case be cocked by means of a cocking element before the first shot is fired. By means of the cocking element, the recoiling part of the weapon is normally moved into a cocked position counter to the force of a spring, which is placed into a stressed state. When the weapon is actuated, the recoiling part of the weapon is then, driven by the force of the spring, accelerated in the direction of the ammunition to be fired, and is subsequently, after the shot has been fired, moved back in the direction of the cocked position owing to the resulting recoil. This process is then repeated for every further shot fired, resulting in a type of pendular motion of the recoiling part of the weapon, and a large number of shots can be fired within short periods of time.

To prevent shots being fired inadvertently, it is often also provided that the weapon can be transferred from an armed state into a safe state in which, for example, the recoiling part of the weapon is blocked such that it is not possible for a shot to be fired. For this purpose, a manually actuable safety locking element is often provided, for example in the form of a pin that can be moved back and forth between two positions and by means of which the weapon can be transferred from an armed state into a safe state and vice versa.

In the case of manual actuation of the weapon, the actions of cocking, making safe and arming do not pose any great difficulties because the corresponding steps can be readily performed by the gunner by hand.

Particular demands arise in the case of weapons which, by way of a weapon station arranged for example on the roof of a military vehicle, can be actuated by the gunner for example from a vehicle interior which is protected against ballistic threats. This is because, in the case of such weapons, the weapon is cocked, made safe and armed not by hand but in automated fashion. Conventionally, for this purpose, both the cocking element and the safety locking element are actuated in each case by means of a separate drive, which has however proven to be cumbersome both in terms of apparatus and in terms of control technology.

Published European Patent Application No. EP 1 499 844 B1 discloses a weapon station, wherein the weapon arranged in the weapon station can be cocked, made safe and armed by means of a single motor drive, whereby the outlay in terms of apparatus and control technology can be kept relatively low. For this purpose, the weapon station has an actuating element which, in the manner of a spindle nut, can be moved axially by means of a motor drive, wherein the actuating element can be coupled to a cocking bolt on the weapon, which is situated in the movement travel of the actuating element and which can be driven along axially by said actuating element for the purpose of cocking the weapon. The actuating element simultaneously operates a spring-loaded blocking lever by means of which the weapon is made safe and armed. The blocking lever is moved back and forth between a release position and a blocking position by the movements of the actuating element, wherein the blocking lever, in its blocking position, blocks the movements of the cocking element on the weapon, whereby a movement of the recoiling part of the weapon is also blocked, and thus shots cannot be fired inadvertently.

In the case of a device of said type, it has proven to be disadvantageous that the blocking lever arranged on the weapon station does not interact with the safety locking element of the weapon itself, but instead, the safety locking of the weapon is realized only by blocking of the cocking element, which in adverse situations, for example in the event of removal of the weapon from the weapon station, harbors the risk of undesired triggering of shots.

SUMMARY

The disclosed device for cocking a weapon is therefore based on the object of providing a device, a weapon station and a method for cocking a weapon, with which the weapon can be not only cocked but also made safe and armed in a simple and reliable manner.

Said object is achieved, in the case of a device and a weapon station of the type mentioned in the introduction, by a control device by means of which the actuating element can be or is coupled to a safety locking element on the weapon for the purpose of making the weapon safe and arming the weapon.

Owing to the fact that the actuating element can be or is coupled by means of a control device to the safety locking element on the weapon, it is possible for the weapon to be cocked, and simultaneously also made safe and armed, in a simple manner. Owing to the coupling to the actuating element, no additional drive is required for the function of making the weapon safe and arming the weapon. Furthermore, owing to the coupling to the safety locking element on the weapon, the weapon is made safe in a particularly reliable manner, wherein there is no increased risk of undesired triggering of shots even in the event of removal of the weapon from the weapon station.

In a refinement of the disclosed device for cocking a weapon, it is proposed that the actuating element can be moved by means of an in particular electromotive drive for the purpose of cocking the weapon and also for the purpose of making the weapon safe and arming the weapon. The use of an electromotive drive yields a construction which is advantageous both from a control technology aspect and from a cost aspect. The drive is preferably in the form of a linear drive, for example a spindle drive or toothed rack drive.

A further refinement of the disclosed device provides the control device with a control element which is movable jointly with the actuating element, and a control element which is arranged at the weapon side. Whereas one control element is coupled to the actuating element of the cocking device, the control element at the weapon side is coupled to the safety locking element on the weapon. The two control elements serve for converting the movements of the actuating element into a defined movement of the safety locking element on the weapon. The control elements particularly preferably convert a linear movement of the actuating element into a linear movement directed orthogonally with respect to said movement, or a rotational or pivoting movement, of the safety locking element on the weapon. In this way, by moving the actuating element, the weapon can be made safe or armed, specifically by way of the safety locking element provided on the weapon.

In one embodiment, the safety locking element on the weapon is preferably in the form of a disk-type or rotary safety lock. The safety locking element on the weapon may be arranged on the top side, the underside or on a side surface of the weapon, preferably on that side surface of the weapon which points in the direction of the cocking device.

In terms of construction, it has proven to be particularly advantageous if the control elements interact such that movements of the actuating element in and/or counter to the cocking direction of the weapon are converted into a movement of the safety locking element transversely with respect to the cocking direction of the weapon.

In a refinement in terms of construction, the control element which is movable jointly with the actuating element is formed in the manner of a control track. By means of the control track, the movement, directed axially in the cocking direction of the weapon, of the control element arranged on the actuating element can be converted in a simple manner into a transverse or pivoting movement of the control element arranged at the weapon side.

A further advantageous refinement provides that the control track has control sections which extend in a direction which is angled relative to the cocking direction of the weapon. The transmission of the movement of the control element arranged on the actuating element to the control element arranged at the weapon side takes place on the control sections. Sections which are situated between the control sections and which are directed parallel to the cocking direction of the weapon do not serve for the transmission of movements to the control element at the weapon side.

In a further refinement of the disclosed device, the control track has a bypass for bypassing the control sections. This refinement is advantageous in particular in the case of weapons which can be cocked only when in the armed state. In the case of such weapons, for cocking the weapon, it is possible for the bypass, extending parallel to the cocking direction of the weapon, of the control track to be utilized initially, and for the weapon to subsequently be made safe by virtue of the control sections being travelled through. In the control sections, the safety locking element on the weapon is changed over or switched, whereby the recoiling part of the weapon is blocked at the weapon side. The ends of the control track preferably form, together with the bypass, a straight section over the entire length of the control track. In particular, two control sections branch off from said straight section, which control sections are preferably connected to one another by way of a section running parallel to the straight section. The bypass extends on the first straight section between the two control sections.

In a refinement of the device for cocking a weapon, the bypass is equipped, at the entry and/or exit side(s), with switches. By means of the switches, it is possible for either the control section or the bypass to be opened up or blocked. The switches are preferably designed so as to open up the bypass during the cocking of the weapon and to open up the control sections during the return movement or for the purpose of making the weapon safe.

A further refinement of the device provides that the control element which is arranged at the weapon side is formed in the manner of a disengagement lever. This serves for the actuation of the safety locking means on the weapon. The control element arranged at the weapon side preferably has means, in particular a clamping element, for coupling to the safety locking element on the weapon.

It has furthermore proven to be advantageous from a construction aspect for the control elements to be coupled to one another by means of an intermediate element. The intermediate element may be guided on the control element, in particular the control track, arranged on the actuating element, and thus transmit a movement of said control element to the control element arranged at the weapon side. The intermediate element may be fixedly connected to the control element arranged at the weapon side.

In a further refinement of the device, the control elements are coupled to one another by means of the intermediate element such that axial movements of the control element are converted, via the control sections, into transverse movements of the control element at the weapon side. The weapon is made safe and armed by means of the transverse movements of the control element at the weapon side owing to the coupling to the safety locking element on the weapon.

In a refinement of the device and weapon station, the control sections form a control travel, directed transversely with respect to the cocking direction, greater than the safety locking travel of the safety locking element. It can be ensured in this way that the safety locking means of the weapon is reliably actuated. Manufacturing and/or assembly tolerances are reliably compensated for.

From a construction aspect, it has furthermore proven to be advantageous for the intermediate element to be of resilient design for the compensation of differences between the control travel and the safety locking travel. A resilient design of the intermediate element firstly permits compensation of tolerances, and secondly, it is possible even for weapons with different safety locking travels to be made safe and armed by means of the device. The intermediate element preferably has a leaf spring.

In the case of a method of the type mentioned in the introduction, the above-stated object is achieved in that the actuating element is coupled by means of a control device to a safety locking element on the weapon, and is moved axially for the purpose of making the weapon safe and arming the weapon.

Owing to the fact that the actuating element, which is movable for the purpose of cocking the weapon, is coupled by means of a control device to the safety locking element on the weapon, it is possible for the weapon to be cocked, and simultaneously also made safe and armed, in a simple manner. Owing to the coupling to the actuating element, no additional drive is required for the functions of making the weapon safe and arming the weapon. Furthermore, owing to the coupling to the safety locking element on the weapon, the weapon is made safe in a particularly reliable manner, wherein there is no increased risk of undesired triggering of shots even in the event of removal of the weapon from the weapon station.

For carrying out the method, the cocking device may have, individually or in combination, all of the features described above in conjunction with the device and the weapon station.

BRIEF DESCRIPTION OF THE DRAWINGS

Further details of a device according to the invention and of a weapon station according to the invention and also of a method according to the invention will be explained below with reference to the appended drawings of exemplary embodiments, in which.

DETAILED DESCRIPTION

Figure 1:
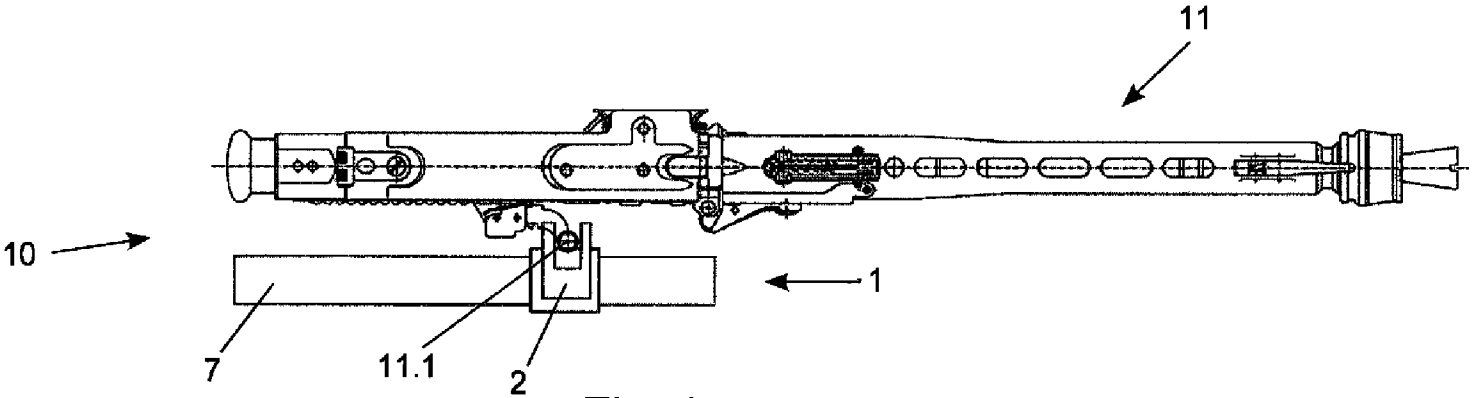
FIG. 1 shows a schematic plan view of a device according to the invention in a schematic view, in which not all components are shown.
Figure 2:
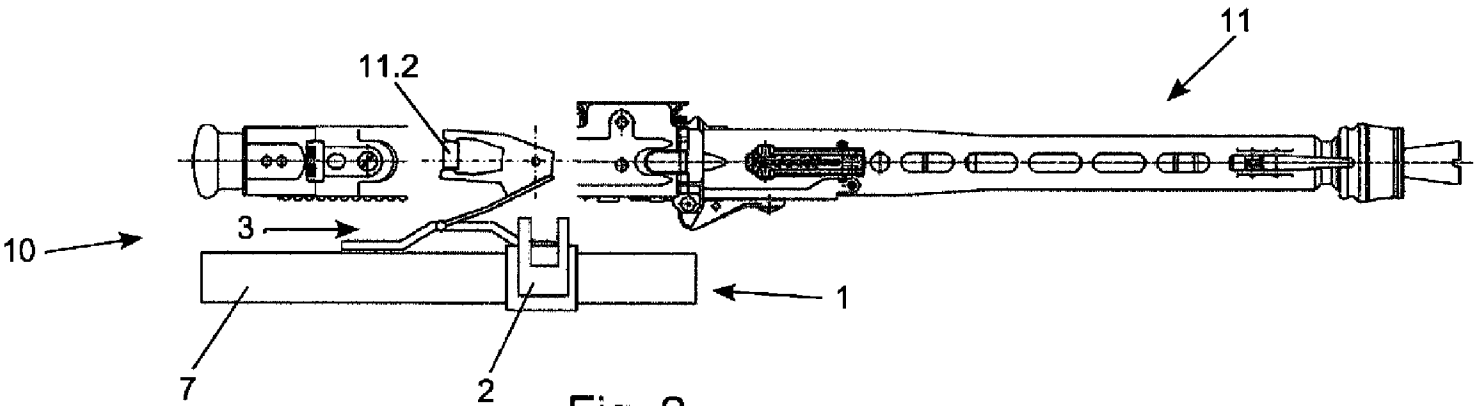
FIG. 2 shows a schematic plan view of a device according to the invention in a schematic view, in which not all components are shown.

FIGS. 1 and 2 show a weapon 11 which is a commercially available, also manually operable machine gun, which is received in a weapon station 10 (only partly illustrated).

By means of the weapon station 10, the weapon 11 can, by a gunner, be directed in terms of azimuth and elevation toward a target to be engaged. In this case, the gunner may be located at some distance from the weapon 11 in a space which is protected against military threats, such as for example a vehicle cabin with ballistic protection, such that the gunner is protected against hostile threats while firing shots.

However, before the weapon 11 can be actuated, it must be cocked by means of a cocking element 11.1 arranged on the weapon 11, for which purpose the cocking element 11.1 is moved counter to the firing direction of the weapon 11 into a cocking position. In this case, by means of the cocking element 11.1, a recoiling part (not illustrated) of the weapon 11 is moved into a cocked position counter to the force of a spring, which is placed into a stressed state. Then, when the weapon 11 is triggered, the recoiling part of the weapon 11 is accelerated in the direction of the ammunition by means of the stressed spring and, when it impacts against the ammunition, triggers the shot. After the shot has been fired, the recoiling part of the weapon 11 is moved into the cocked position again owing to the resulting recoil. Here, multiple triggering of the weapon 11 results in a pendular motion of the recoiling part of the weapon 11, and a multiplicity of shots can be fired within short periods of time.

Before the first shot is fired, it is also necessary for the weapon 11 to be armed. For this purpose, the weapon 11 has a safety locking element 11.2 which is arranged on the weapon 11 and which is configured in the manner of an axially movable pin which, in its safe position, blocks the recoiling part of the weapon 11, such that in the safe position of the weapon 11, no shots can be fired. Shooting is possible only when the safety locking element 11.2 has been moved into an armed position.

The weapon 11 can generally be cocked, made safe and armed without difficulty in the case of manual actuation, because the corresponding cocking and safety locking elements are arranged directly on the weapon 11 and can be operated within an extremely short time by experienced gunners. Particular demands arise when the weapon 11 is operated within the remote-operable weapon station 10, for which purpose a cocking device 1 is provided, the details of which will be discussed below.

FIG. 1 shows a device 1 for cocking a weapon 11 and making the weapon safe, said device having an actuating element 2 which is movable axially in the cocking direction of the weapon 11 by means of a drive 7. The actuating element 2, and also the associated drive 7 which may for example be an electromotive linear drive, are arranged on the weapon station 10 and interact with the weapon 11 that is placed into the weapon station 10.

The actuating element 2 is coupled to the cocking element 11.1 on the weapon such that the cocking element 11.1 follows the axial movements of the actuating element 2, such that the weapon 11 can be cocked by way of movement of the actuating element 2.

As shown in particular in the illustration in FIG. 2, in which the cocking element 11.1 on the weapon is not shown, the actuating element 2 performs a dual function. This is because the actuating element 2 serves not only for cocking the cocking element 2 but simultaneously also for actuating the safety locking element 11.2 on the weapon. For this purpose, the actuating element 2 is coupled to the safety locking element 11.2 by means of a control device 3, such that the weapon 11 can be made safe and armed by means of corresponding movements of the actuating element 2.

Structural details of a first exemplary embodiment will firstly be described in detail below on the basis of the illustration in FIG. 3, before the corresponding processes during the cocking of the weapon 11, and the process of making the weapon 11 safe, by means of the device 1 are described on the basis of the illustrations in FIGS. 4*a* to 4*c*.

Figure 3:
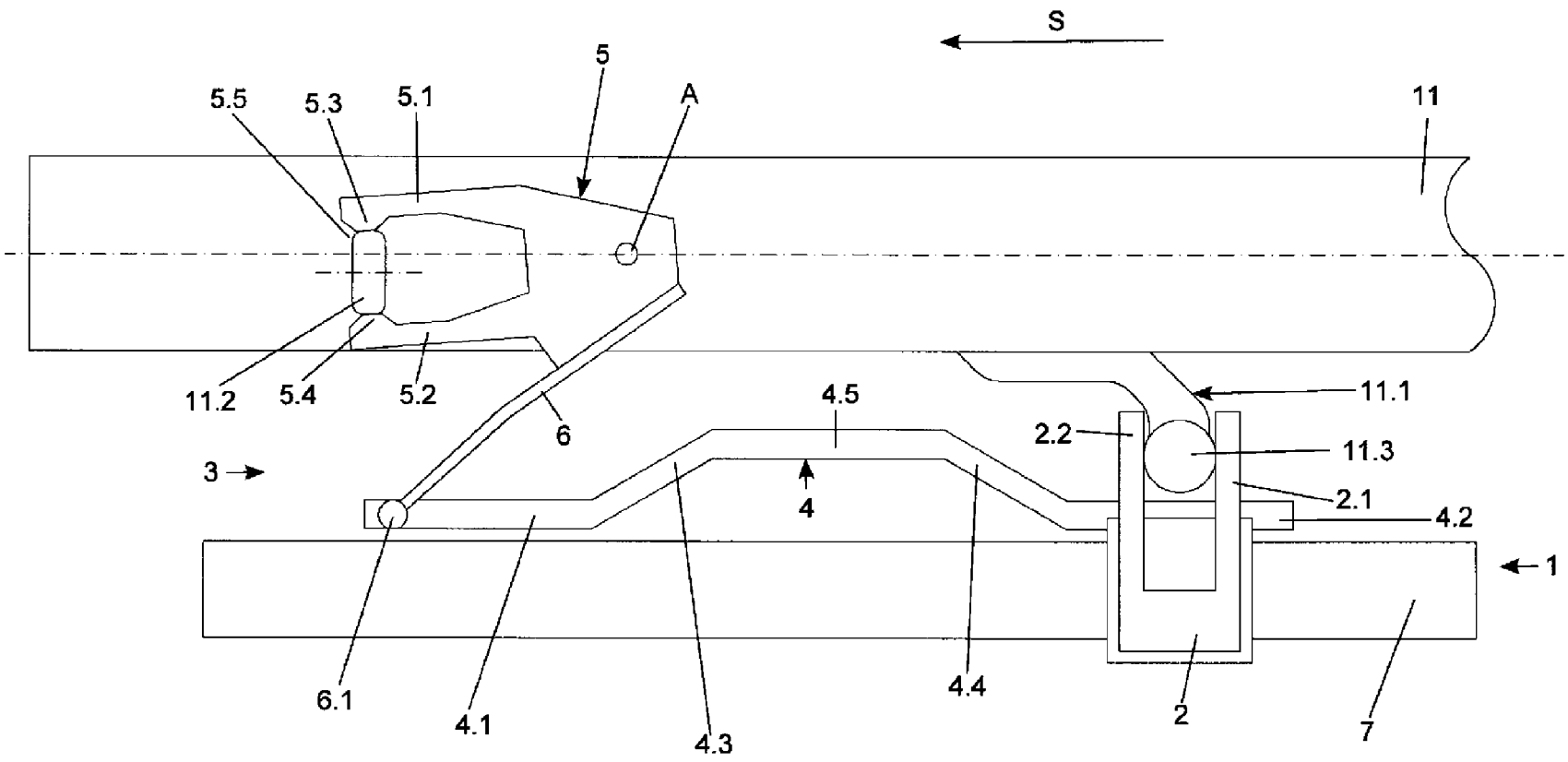
FIG. 3 shows an enlarged view of a device according to a first exemplary embodiment.

FIG. 3 shows a cocking device 1 which extends substantially parallel to the weapon 11 inserted into the weapon station 10. For cocking the weapon 11, a linear drive 7 is provided, by means of which an actuating element 2 can be moved back and forth in a direction parallel to the firing direction of the weapon 11. Both the cocking element 11.1 of the weapon 11 and the safety locking element 11.2 of the weapon 11 are coupled to the actuating element 2, such that both the cocking element 11.1 and the safety locking element 11.2 can be actuated by means of the common actuating element 2, and thus by means of only one drive 7.

The coupling of the actuating element 2 to the cocking element 11.1 of the weapon 11 is such that the cocking element 11.1 follows the movements of the actuating element 2. The actuating element 2 thus forms a driver for the cocking element 11.1 of the weapon 1, by means of which driver the cocking element 11.1 can be moved into its cocked position, and the weapon 11 can be cocked. In the exemplary embodiment, the cocking element 11.1 of the weapon 11 has a pin-like section 11.3 which engages into a U-shaped opening of the actuating element 2. The cocking element 11.1 can be driven in two directions by means of the two legs 2.1, 2.2 of the U-shaped opening.

The coupling of the actuating element 2 to the safety locking element 11.2 of the weapon 11 is realized by means of a control device 3. Whereas the coupling of the actuating element 2 to the cocking element 11.1 is such that the cocking element 11.1 follows the movements of the actuating element 2, the coupling of the actuating element 2 to the safety locking element 11.2 is such that the movements of the actuating element 2 are converted, by means of the control device 3, into a differently oriented movement of the safety locking element 11.2.

The weapon 11 provided in the exemplary embodiment is made safe and armed by linear movement of the safety locking element 11.2 transversely with respect to the direction of the weapon 11. The invention is however not restricted to weapons 11 with safety locking elements 11.2 of this type. For example, it may also be the case that the safety locking element 11.2 is pivoted or rotated in order to make the weapon 11 safe. In a device 1 according to the invention, these movements, too, may be generated from the linear movements of the actuating element 2 by means of a suitable control device 3.

The control device 3 has a first control element 4 at the actuating element side and second control element 5 at the weapon side, which are connected to one another by means of an intermediate element 6.

The control element 4 at the actuating element side is coupled to the actuating element 2 so as to move jointly with the actuating element 2. During the cocking of the weapon 11, the control element 4 thus follows the movements of the actuating element 2.

The control element 4 is formed in the manner of a control track which has different sections. The two ends of the control track 4 are formed by linear sections 4.1, 4.2 which extend parallel to the cocking direction of the weapon 1 and thus to the movement direction of the actuating element 2. In the exemplary embodiment, the end-side linear sections 4.1, 4.2 of the control track 4 are arranged in alignment with one another. In the direction of the center of the control track 4, the two end-side sections 4.1, 4.2 are adjoined by first and second control sections 4.3, 4.4, respectively. The control sections 4.3, 4.4 extend in a direction which is angled relative to the end-side sections 4.1, 4.2. The control sections 4.3, 4.4 are angled linear sections, though use may also be made of control sections 4.3, 4.4 of some other form, in particular curved control sections. The two control sections 4.3, 4.4 are arranged symmetrically with respect to a central plane of the control track 4, and enclose between them a central linear section 4.5 which connects the control sections 4.3, 4.4 to one another, resulting in a continuous control track 4. The central linear section 4.5 is arranged parallel and offset with respect to the end-side linear sections 4.1, 4.2, resulting in a type of trapezoid.

The control element 5 at the weapon side is coupled to the safety locking element 11.2 on the weapon and serves for transmitting a movement of the actuating element 2 to the safety locking element 11.2 on the weapon. By means of a movement of the control element 5, the safety locking element 11.2 can be switched, that is to say moved back and forth between an armed position and a safe position of the weapon 11.

For coupling to the safety locking means 11.2 on the weapon, the control element 5 has an opening 5.5 in which the safety locking means 11.2 on the weapon is held. The opening 5.5 is delimited by two limbs 5.1, 5.2 which extend substantially parallel. The limbs 5.1, 5.2 clamp the safety locking element 11.2 between them, for which purpose the opening 5.5 may have a certain undersize in relation to the safety locking element 11.2. To allow certain movements of the safety locking element 11.2 on the weapon relative to the control element 5 at the weapon side, the ends of the limbs 5.1, 5.2 each have an elevation 5.3, 5.4 in the region of contact with the safety locking element 11.2 on the weapon. To make it easier for the safety locking element 11.2 to be inserted into the opening 5.5, the elevations 5.3, 5.4 are each equipped with insertion bevels. Altogether, the control element 5 at the weapon side has a pincer-like geometry and is mounted so as to be pivotable about a pivot axis A, preferably in a pivot bearing (not illustrated in the figures) of the device 1.

The two control elements 4, 5 are operatively connected to one another by means of the intermediate element 6. The intermediate element 6 is fixedly connected, by one end, to the control element 5 at the weapon side, such that a movement of the intermediate element 6 leads to a pivoting movement of the control element 5 about the axis A. By its other end, the intermediate element 6 is coupled to the control element 4 at the actuating element side. The intermediate element 6 has, for this purpose, a sliding element 6.1 which is guided in the manner of a sliding block in the control element 4, which is in the form of a control track. During the movement of the control element 4 jointly with the actuating element 2, a sliding element 6.1 moves in the control track 4. The resulting movement leads to a movement of the intermediate element 6, and thus to a pivoting movement of the control element 5, whereby the safety locking element 11.2 of the weapon 11 can be switched.

The processes during the cocking of the weapon 11, and the processes of making the weapon 11 safe and arming the weapon 11, will be explained in detail below on the basis of the illustrations in FIGS. 4*a* to 4*e*.

Figure 4A:
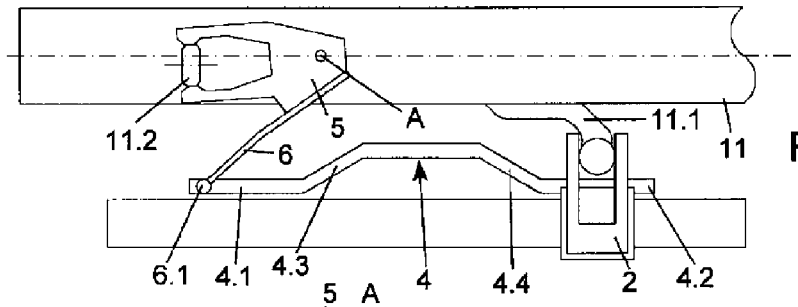
FIGS. 4*a-e* show schematic views of a device as per the illustration in FIG. 3, illustrating the processes during the cocking of the weapon and the processes of making the weapon safe and arming the weapon.
Figure 4B:
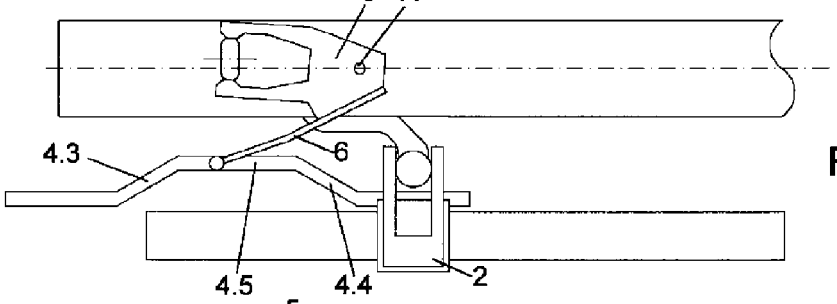
Figure 4C:
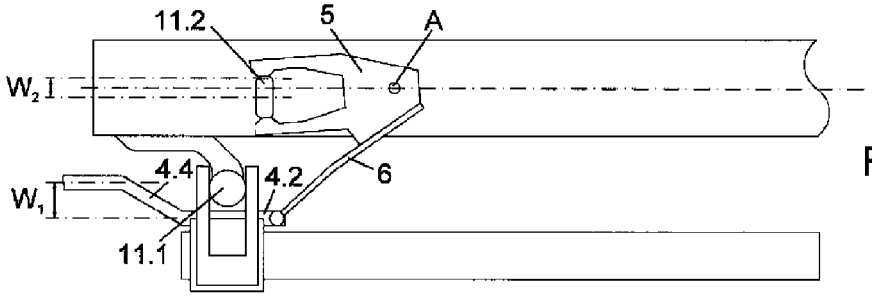

FIG. 4*a* shows the device 1 with an uncocked, armed weapon 11. To cock the weapon 11, the actuating element 2 moves from the forward position illustrated in FIG. 4*a* into the cocked position illustrated in FIG. 4*c* counter to the firing direction of the weapon 11. In the process, the actuating element 2 drives along the cocking lever 11.1 of the weapon 11, whereby the recoiling part (not illustrated in the figures) of the weapon 11 is also transferred into its cocked position. In this position, the weapon 11 is cocked and thus prepared for the firing of a first shot.

After the weapon 11 has been cocked, the actuating element 2 can be moved back in the firing direction together with the cocking element 11.1 of the weapon 11.

During the movement of the actuating element 2, the safety locking element 11.2 of the weapon 11 is actuated simultaneously because the actuating element 2 is coupled to the safety locking element 11.2 by means of the control device 3. Since the actuating element 2 is fixedly connected to the control element 4, in the form of a control track, of the control device 3, the actuating element 2 drives the control element 4 along. During said movement, the sliding element 6.1 of the intermediate element 6 runs through the control track 4, such that the control element 5 pivots about the pivot axis A.

In the position shown in FIG. 4*a*, the weapon 11 is armed, which can be seen from the fact that the safety locking element 11.2 is situated in the lower end position in the drawings. During the movement of the actuating element 2, the weapon 1 then remains armed until the intermediate element 6, or the sliding element 6.1 thereof, enters the section 4.1 and the control section 4.3. The control section 4.3 is inclined relative to the section 4.1, such that the intermediate element 6, and with that the rotatably mounted control element 4, are moved in accordance with the gradient of the control section 4.3 until the safety locking element 11.2 has, as per the illustration in FIG. 4*b*, reached its safe position in which firing of shots is not possible even when the weapon 11 is cocked. During the further movement of the actuating element 2, the intermediate element 6 runs through the central section 4.5, which is directed parallel to but is offset with respect to the end-side sections 4.1, 4.2. As the section 4.5 is passed through, the weapon initially remains in its safe state until the next control section 4.4 is reached. The control section 4.4 is oriented oppositely with respect to the control section 4.3, such that after the second control section 4.4 has been passed through, the safety locking element 11.2 is armed again. When the end-side linear section 4.2 has then also been passed through, as per the illustration in FIG. 4*c*, the weapon 11 is armed and cocked.

Figure 4D:
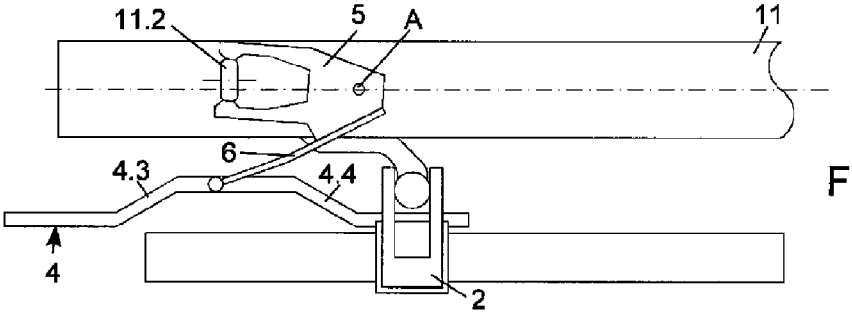
Figure 4E:
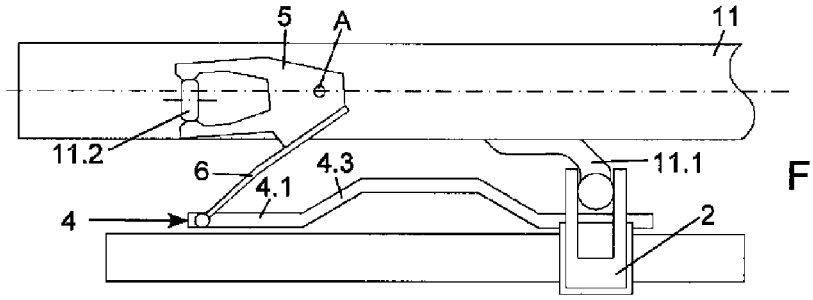

After the cocking of the weapon 11, the actuating element 2 is moved back into its initial position, cf. FIGS. 4*d* and 4*e*.

In the process, the actuating element 2 drives the control track-like control element 4 back along with it, wherein the safety locking element 11.2 on the weapon is switched again in the control sections 4.4, 4.3, and the weapon 11 is situated in the cocked and armed state in the position illustrated in FIG. 4*e*.

If it is now sought to make the weapon 11 safe, the actuating element 2 can be moved again. In this case, although the cocking element 11.1 is driven along in turn, this however has no influence on the recoiling part of the weapon 11 because the latter is already situated in its cocked position. The actuating element 2 can thus be moved merely with the aim of switching the safety locking element 11.2 on the weapon and thus making the weapon safe or arming the weapon.

For the compensation of tolerances, and in order to make it possible for a weapon station 10 to receive different weapons 11 whose safety locking elements 11.2 have different safety locking travels, the intermediate element 6 is of resilient form. In FIG. 4*c*, the safety locking travel $W_2$ covered by the safety locking element 11.2 during the movement from the safe position into the armed position, and the control travel $W_1$ made up of the offset between the sections 4.1 and 4.2 and the central section 4.5, are shown. The control travel $W_1$ is greater than the safety locking travel $W_2$. In this way, in combination with the intermediate element 6 in the form of a leaf spring, it is ensured that the safety locking element 11.2 on the weapon is always effectively actuated even taking tolerances into consideration, by virtue of the fact that, owing to the intermediate element 6, the safety locking element 11.2 on the weapon is held in position by means of the control element 5 under spring preload. The combination of the intermediate element 6 of resilient form and the difference in length between the control travel $W_1$ and safety locking travel $W_2$ have the effect that different weapons 11 can be reliably cocked and made safe by the cocking device 1.

As the control sections 4.3, 4.4 are passed through, the sign of the bending stress in the intermediate element 6 changes, such that, in the central section 4.5, said intermediate element pushes the safety locking element 11.2 on the weapon in the direction of its safe position. In the two other linear sections 4.1, 4.2, the safety locking element 11.2 is pulled in the direction of its armed position by means of the intermediate element 6 in the form of a leaf spring.

Below, a second exemplary embodiment of the invention will be described on the basis of the illustrations in FIGS. 5 to 6*e*, which second exemplary embodiment differs from the first exemplary embodiment with regard to the design of the control element 4 in the form of a control track but otherwise substantially corresponds to said first exemplary embodiment, for which reason, in order to avoid repetition, primarily the differences in said design will be discussed.

Figure 5:
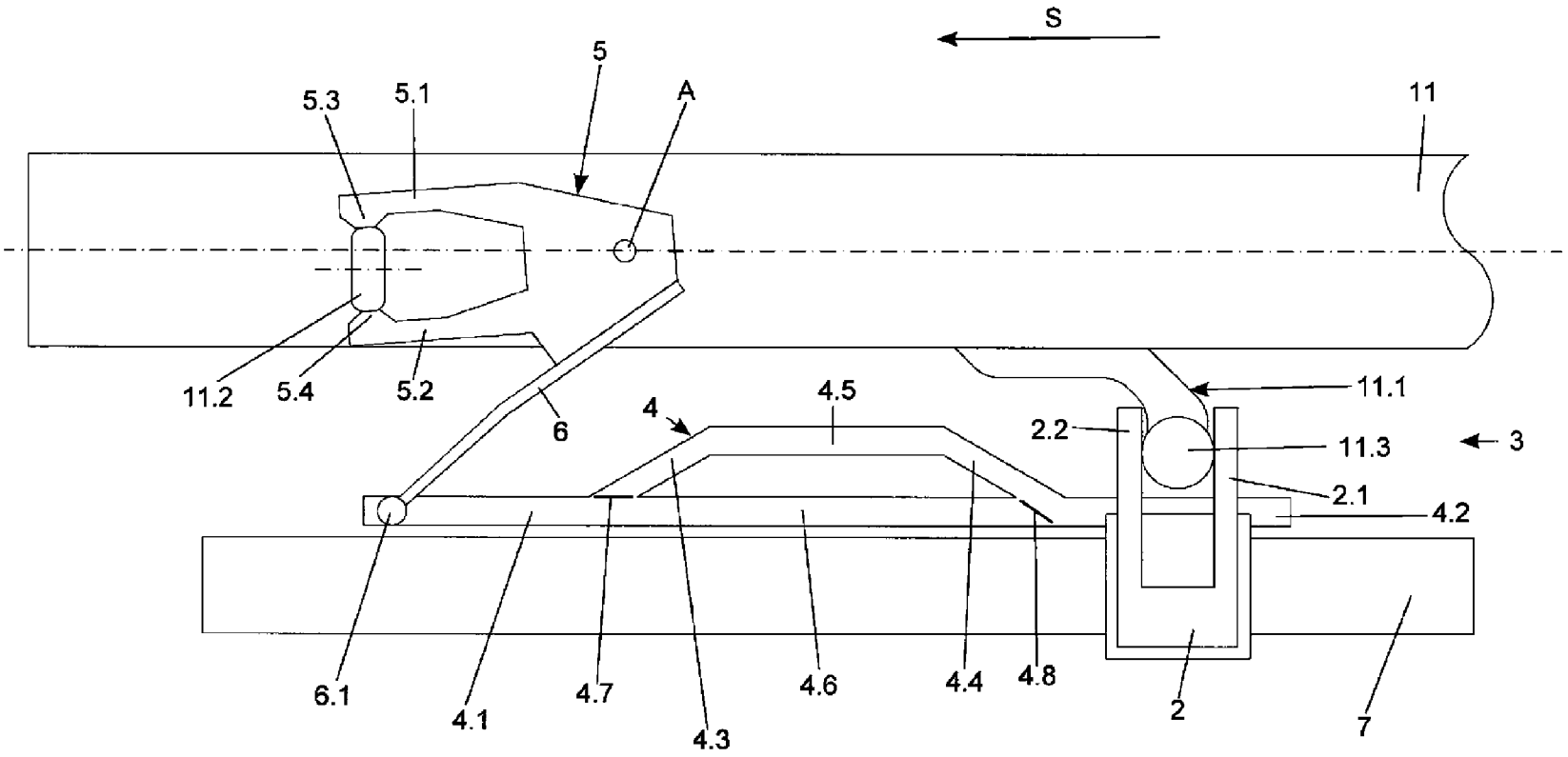
FIG. 5 shows an enlarged view of a device according to a second exemplary embodiment.

Whereas it is the case in the first exemplary embodiment as per FIG. 3 that the control track 4 has only one possible path through which the sliding element 6.1 runs both in one direction and in the other direction, the control track 4 in the second exemplary embodiment as per FIG. 5 additionally has a bypass 4.6. The bypass 4.6 connects the end sections 4.1, 4.2 of the control track 4 directly, so as to bypass the two control sections 4.3, 4.4 and the offset section 4.5. The end-side sections 4.1, 4.2 and the bypass 4.6 are in alignment with one another.

Switches 4.7, 4.8 are arranged at the entry and exit sides of the bypass 4.6, said switches being designed such that the bypass 4.6 is passed through in one movement direction, and the path via the control sections 4.3, 4.4 is followed in the other direction. In the exemplary embodiment, the switches 4.7, 4.8 are designed similarly to spring-loaded check valves, wherein one of the switches 4.7 may also be designed to be actuable, as will be explained in more detail below with reference to the illustrations in FIGS. 6*a* to 6*e*.

Figure 6A:
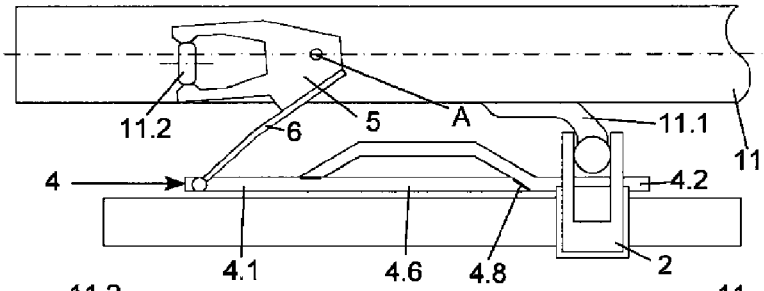
FIGS. 6*a-e* show schematic views of a device as per the illustration in FIG. 5, illustrating the processes during the cocking of the weapon and the processes of making the weapon safe and arming the weapon.
Figure 6B:
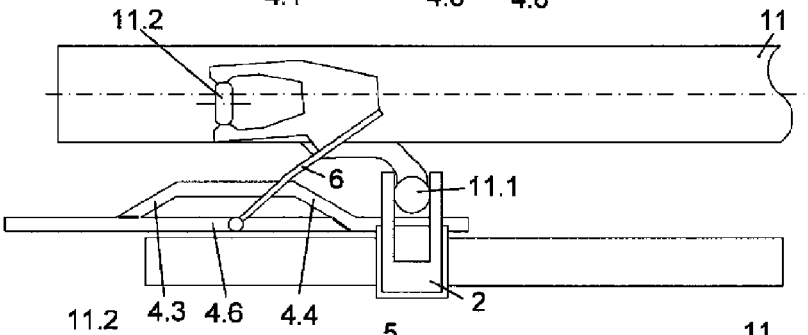
Figure 6C:
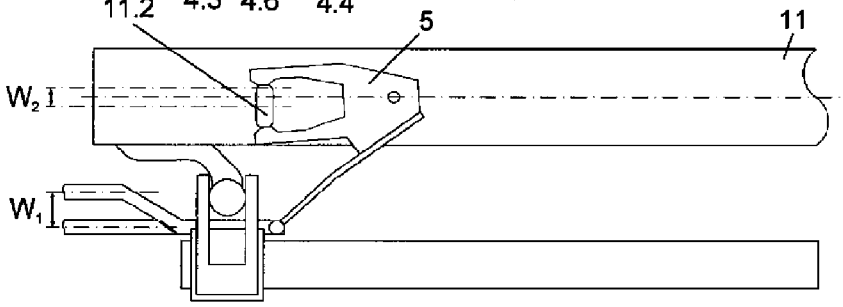
Figure 6D:
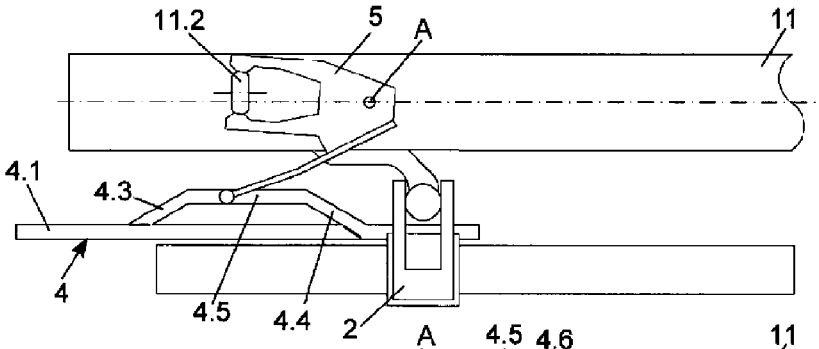
Figure 6E:
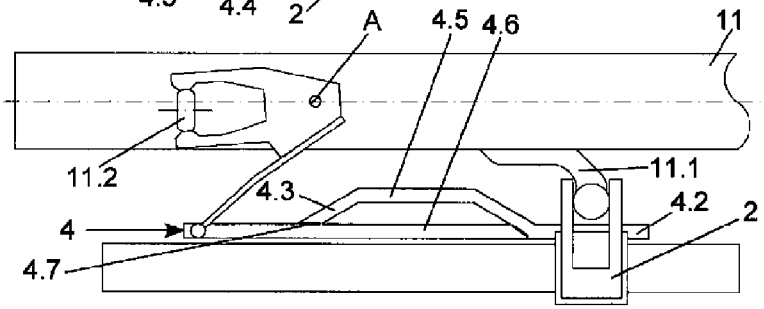

It is again the case that, initially, the actuating element 2 is situated in an initial position as per the illustration in FIG. 6*a*. To cock the weapon 11, the actuating element 2 is then moved counter to the firing direction of the weapon 11, wherein the cocking element 11.1 is driven along into its cocked position, illustrated in FIG. 6*c*. By contrast to the processes described in the first exemplary embodiment, that end of the intermediate element 6 which is formed as a sliding element 6.1 in this case does not pass through the control sections 4.3, 4.4 of the control element 4, but instead follows the direct path from one end 4.1 of the control element to the opposite end 4.2 via the bypass 4.6 arranged so as to lie in between. In the process, the rear switch 4.8 temporarily deflects upward counter to the force of a spring. During the return movement of the actuating element 2, the sliding element 6.1 then however follows a different path via the control section 4.4, the central section 4.5 and the control section 4.3 into the end section 4.1, until the end position illustrated in FIG. 6*e* is reached, in which the weapon is armed and cocked.

To make the weapon safe, it is now possible for the sliding element 6.1 to be moved along the bypass 4.6 again into the end section 4.2 and subsequently moved into the central section 4.5, wherein the safety locking element 11.2 on the weapon is transferred into the safe position.

In the case of this embodiment, owing to the bypass 4.6 and the associated switches 4.7, 4.8, it is possible for the sliding element 6.1 or the intermediate element 6 to follow different paths in each case during the movement of the actuating element 2 in the cocking direction and counter to the cocking direction, which is an advantage in particular in the case of weapons 11 which can be cocked only when in the armed state, or which can be made safe only when they have also been cocked.

The device 1 described above and the weapon station 10 described above and also the method described above are characterized in that, by means of the coupling of a safety locking element 11.2 on the weapon to the actuating element 2 for cocking the weapon 11, a weapon 11 with the actuating element 2 can be cocked and made safe, and owing to the coupling to the safety locking element 11.2 on the weapon, there is no risk of undesired shots being fired even in the event of removal of the weapon 11.

TABLE I

Reference Numbers

1 Device
2 Actuating element
2.1 Limb
2.2 Limb
3 Control device
4 Control element
4.1 Linear section
4.2 Linear section
4.3 Control section
4.4 Control section
4.5 Offset section
4.6 Bypass
4.7 Switch
4.8 Switch

5 Control element
5.1 Limb
5.2 Limb
5.3 Elevation
5.4 Elevation
5.5 Opening
6 Intermediate element
6.1 Sliding element
7 Drive
10 Weapon station
11 Weapon
11.1 Cocking element
11.2 Safety locking element
11.3 Pin
A Pivot axis
S Cocking direction
$W_1$ Control travel
$W_2$ Safety locking travel

What is claimed is:

1. A device for cocking a weapon (11) having an axially movable actuating element (2) coupled to a cocking element (11.1) on the weapon for the purpose of cocking the weapon (11), the weapon having a safety locking element (11.2) movable between a first position wherein the weapon is in an armed state, and a second position wherein the weapon is in a safe state, the device comprising:

a control device (3) having a first control element (4) including a control track operatively connected to the axially movable actuating element, a second control element (5) having a pivot axis (A) and coupled to the safety locking element (11.2) on the weapon, such that pivotal movement of the second control element actuates the safety locking element between the first position and the second position, and an intermediate element having a first end connected to the second control element and a second end coupled to the control track of the first control element, whereby axial movement of the actuating element with the first control element causes the second end to follow the control track and pivot the second control element to move the safety locking element between the first position and the second position, whereby the weapon (11) is simultaneously made safe and is armed by actuation of the actuating element (2).

2. A weapon station comprising:

a weapon (11) having a cocking device (1) with an axially movable actuating element (2) coupled to a cocking element (11.1) on the weapon for the purpose of cocking the weapon (11), and a safety locking element (11.2) movable between a first position wherein the weapon is in an armed state, and a second position wherein the weapon is in a safe state; and a control device (3) having a first control element (4) including a control track operatively connected to the axially movable actuating element, a second control element (5) having a pivot axis (A) and coupled to the safety locking element (11.2) on the weapon, such that pivotal movement of the second control element actuates the safety locking element between the first position and the second position, and an intermediate element having a first end connected to the second control element and a second end coupled to the control track of the first control element, axial movement of the actuating element with the first control element causes the second end to follow the control track and pivot the second control element to move the safety locking element between the first position and the second position, whereby the weapon (11) is simultaneously made safe and is armed by actuation of the actuating element (2).

3. The device as claimed in claim 1, wherein the actuating element (2) is moved by an electromotive drive (7) for the purpose of cocking the weapon (11) and also for the purpose of making the weapon (11) safe and arming the weapon (11).

4. The device as claimed in claim 1, wherein the second control element (5) which is arranged at the weapon side.

5. The device as claimed in claim 4, wherein the first and second control elements (4, 5) interact such that movement of the actuating element (2) in a cocking direction (S) of the weapon (11) is converted into a movement of the safety locking element (11.2) transversely with respect to the cocking direction (S) of the weapon (11).

6. The device as claimed in claim 1, wherein the intermediate element includes a sliding element that engages follows the control track.

7. The device as claimed in claim 6, wherein the control track (4) has first and second control sections (4.3, 4.4) which extend in a direction which is angled relative to a cocking direction (S) of the weapon (11).

8. The device as claimed in claim 7, wherein the control track (4) has a bypass (4.6) for bypassing the first and second control sections (4.1).

9. The device as claimed in claim 8, wherein the bypass (4.6) is equipped, at one or both of entry and exit sides thereof, with switches (4.4).

10. The device as claimed in claim 4, wherein the second control element (5) includes a disengagement lever.

11. The device as claimed in claim 1, wherein the control track includes a first control section and a second control section shaped such that axial movements of the first control element (4) are converted, via the first and second control sections (4.1), into transverse movements of the second control element (5) at the weapon side.

12. The device as claimed in claim 7, wherein the first and second control sections (4.3, 4.4) form a control travel (WA directed transversely with respect to the cocking direction, greater than the safety locking travel ($W_2$) of the safety locking element (11.2).

13. The device as claimed in claim 11, wherein the intermediate element (6) is of resilient design for the compensation of differences between the control travel ($W_1$) and the safety locking travel ($W_2$).

14. The weapon (11) of claim 1, wherein the weapon is an automatic weapon.

15. A method for providing a weapon (11) having a cocking element for cocking the weapon with a device (1) for cocking the weapon, the weapon having a safety locking element (11.2) movable between a first position wherein the weapon is in an armed state, and a second position wherein the weapon is in a safe state, the method comprising:

connecting an axially movable actuating element (2) of the device for cocking the weapon to the cocking element for cocking the weapon; and coupling the actuating element (2) to the safety locking element (11.2) on the weapon by means of a control device (3) by coupling to the actuating element a first control element (4) including a control track operatively connected to the axially movable actuating element that is movable jointly with the actuating element, coupling a first end of an intermediate element to the first control element, and coupling to a second end of the intermediate element a second control element having a pivot axis (A) and that is coupled to the safety locking element, such that axial movement of the actuating element with the first control element causes the second end to follow the control track and pivot the second control element to move the safety locking element between the first position and the second position, whereby the weapon (11) is simultaneously made safe and is armed by actuation of the actuating element (2).

16. The method of claim 15, wherein coupling the actuating element (2) to the safety locking element (11.2) includes coupling the actuating element to the safety locking element by mounting the second control element (5) on the weapon for pivotal movement.

17. The method of claim 16, further comprising operatively connecting the first control element (4) to the intermediate element (6) by a sliding element.

18. The method of claim 17, wherein operatively connecting the intermediate element (6) to the first ft control element (4) includes connecting the intermediate element to the control track (4) such that the sliding element engages a first control section that is inclined relative to a second control section, such that the intermediate element and the second control element are moved in accordance with the gradient of the first control section until the safety locking element reached the second position.

19. The method of claim 15, further comprising placing the weapon in a weapon station.

* * * * *